US009000996B2

(12) United States Patent
Holland et al.

(10) Patent No.: US 9,000,996 B2
(45) Date of Patent: Apr. 7, 2015

(54) MODULAR WIDEBAND ANTENNA ARRAY

(75) Inventors: Steven S. Holland, Amherst, MA (US); Marinos N. Vouvakis, Amherst, MA (US); Daniel H. Schaubert, Amherst, MA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 615 days.

(21) Appl. No.: 12/849,112

(22) Filed: Aug. 3, 2010

(65) Prior Publication Data

US 2011/0057852 A1 Mar. 10, 2011

Related U.S. Application Data

(60) Provisional application No. 61/230,768, filed on Aug. 3, 2009.

(51) Int. Cl.
*H01Q 9/28* (2006.01)
*H01Q 13/08* (2006.01)
*H01Q 21/06* (2006.01)

(52) U.S. Cl.
CPC ..... *H01Q 13/085* (2013.01); *H01Q 9/28* (2013.01); *H01Q 21/062* (2013.01); *H01Q 21/064* (2013.01)

(58) Field of Classification Search
USPC ..... 343/795, 700 MS, 846, 702, 853, 786, 343/767, 845
See application file for complete search history.

(56) References Cited

U.S. PATENT DOCUMENTS

| | | | | |
|---|---|---|---|---|
| 3,747,114 | A | 7/1973 | Shyhalla | |
| 3,845,490 | A | 10/1974 | Manwarren et al. | |
| 4,782,346 | A * | 11/1988 | Sharma | 343/795 |
| 4,825,220 | A | 4/1989 | Edward et al. | |
| 5,428,364 | A | 6/1995 | Lee et al. | |
| 5,557,291 | A * | 9/1996 | Chu et al. | 343/725 |
| 5,892,486 | A | 4/1999 | Cook et al. | |
| 6,512,487 | B1 | 1/2003 | Taylor et al. | |
| 7,138,947 | B2 * | 11/2006 | Fisher et al. | 343/700 MS |
| 8,325,093 | B2 * | 12/2012 | Holland et al. | 343/700 MS |
| 2005/0280589 | A1 * | 12/2005 | Chiang et al. | 343/702 |

(Continued)

OTHER PUBLICATIONS

Pickles, Antennas and Propagation Society International Symposium 2007, Coincident phase center ultra wideband array of dual polarized flared notch elements, Jun. 9, 2007, pp. 4421-4424.*

(Continued)

*Primary Examiner* — Sue A Purvis
*Assistant Examiner* — Jae Kim
(74) *Attorney, Agent, or Firm* — US Naval Research Laboratory; Kerry L. Broome

(57) ABSTRACT

A modular wideband antenna element for connection to a feed network. There is a ground plane, and first and second flared fins above the ground plane. The fins each define a connection location that is relatively close to the ground plane and tapering to a free end located farther from the ground plane. The connection location of the first fin is electrically coupled to the feed network and the connection location of the second fin is electrically coupled to the ground plane. There are one or more additional first traces electrically connecting the first fin to the ground plane and one or more additional second traces electrically connecting the second fin to the ground plane.

19 Claims, 24 Drawing Sheets

(56) References Cited

U.S. PATENT DOCUMENTS

| | | | | |
|---|---|---|---|---|
| 2007/0222696 | A1 | 9/2007 | Wikstrom et al. | |
| 2008/0211726 | A1 * | 9/2008 | Elsallal et al. | 343/770 |
| 2009/0051619 | A1 | 2/2009 | Hook et al. | |

OTHER PUBLICATIONS

Elsallal, M. W., "Doubly-Mirrored Balanced Antipodal Vivaldi Atenna (DmBAVA) for High Performance Arrays of Electrically Short, Modular Elements," PhD dissertation, and Computer Engineering, Univ. of Massachusetts, Feb. 2008.

Elsallal, M. W., et al., "Parameter Study of Single Isolated Element and Infinite Arrays of Balanced Antipodal Vivaldi Antennas," 2004 Ant. Apps. Symp. pp. 45-69, 15-17, Sep. 2004.

Elsallal, M. W., et al., "Reduced-Height Array of Balanced Antipodal Vivaldi Antennas (BAVA) with Greater Than Octave Bandwidth," Ant. Apps. Symp. pp. 226-242, 21-23 Sep. 2005.

Gazit, E., "Improved Design of the Vivaldi Antenna," Proc. IEE Microw., Antennas Propag., vol. 135, pp. 89, 1988.

Gibson, P. J., "The Vivaldi Aerial," Proc. 9th European Microwave Conference, 1979, pp. 101-105.

Langley, J. D., et al., "Balanced Antipodal Vivaldi Antenna for Wide Bandwidth Phased Arrays," IEEE Proc. of Microwave and Antenna Pro., vol. 143, No. 2, Apr. 1996, pp. 97-102.

Lee, J.J. et al, "Wide Band Bunny-Ear Radiating Element," Antennas and Propagation Society International Symposium, AP-S Digest, pp. 1604-1607, 1993.

Schaubert, D. H. et al., "Vivaldi Antenna Arrays for Wide Bandwidth and Electronic Scanning," Antennas and Propagation, 2007. The Second European Conference on Antennas and Propogation, 2007 (EuCAP 2007), pp. 1-6, Nov. 11-16, 2007.

* cited by examiner

MODULAR WIDEBAND ANTENNA ARRAY

CROSS-REFERENCE TO RELATED APPLICATION

This application claims priority of Provisional Pat. Application Ser. No. 61/230,768 filed on Aug. 3, 2009, the entire contents of which are incorporated herein by reference.

STATEMENT REGARDING FEDERALLY SPONSORED RESEARCH

This invention was made with government support under grant number PG# 11320000000008, contract number N00173-08-1-G033, awarded by the Naval Research Laboratory. The government has certain rights in this invention.

FIELD

The invention is in the field of wideband phased array antennas, which are used extensively in the field of communications and radar systems.

BACKGROUND

Wideband phased arrays are desirable for use in high-throughput communication systems, such as cellular and satellite systems, as well as radar systems, electromagnetic countermeasure systems, and multifunctional communications/sensing systems.

A popular wideband array element is the Vivaldi antenna, also called a "tapered slot antenna", first proposed by Gibson in 1979 (P. J. Gibson, "The Vivaldi Aerial," Proc. 9th European Microwave Conference, 1979, pp. 101-105.). The element consists of a flared slot structure that has been studied extensively since its inception, leading to theoretical and empirical developments that have extended its performance to achieve over a decade of bandwidth with good scan performance. For wideband scanning arrays the tapered slot has been the dominant technology. However, the Vivaldi elements have two main drawbacks: elements are large, typically a few wavelengths in size at the high end of the operating band, and are not modular since they require electrical connection between neighboring elements for good performance. It has been found that absence of electrical continuity between neighboring elements or subarrays introduces resonances that drastically reduce the achievable bandwidth (Schaubert, D. H.; Kasturi, S.; Boryssenko, A. O.; Elsallal, W. M., "Vivaldi Antenna Arrays for Wide Bandwidth and Electronic Scanning," The Second European Conference on Antennas and Propagation, 2007(*EuCAP* 2007), pp. 1-6, 11-16 Nov. 2007).

A variation on the Vivaldi antenna is the Antipodal Vivaldi Antenna (AVA), introduced by Gazit in 1988 (E. Gazit "Improved design of the Vivaldi antenna,"Proc. IEEE Microw., Antennas Propag ., vol. 135, pp. 89, 1988.). The AVA consists of a microstrip line transitioning to a slotline structure with an exponential taper. This element has high cross pol due to the offset fins, but this was corrected with the addition of a third fin and the inception of the Balanced Antipodal Vivaldi Antenna (BAVA), introduced by Langely, Hall and Newman (J. D. Langely et al, "Balanced Antipodal Vivaldi Antenna for Wide Bandwidth Phased Arrays," IEEE Proceeding of Microwave and Antenna Propagations, Vol. 143, No. 2 Apr. 1996, pp. 97-102.). Recently, Elsallal and Schaubert performed extensive numerical studies to understand and improve the performance of the BAVA element in dual and single polarized arrays (M. W. Elsallal and D. H. Schaubert, "Parameter Study of Single Isolated Element and Infinite Arrays of Balanced Antipodal Vivaldi Antennas, "2004Antenna Applications Symposium, Allerton Park, Monticello, Ill., pp. 45-69, 15-17 Sep., 2004.) and (M. W. Elsallal and D. H. Schaubert, "Reduced-Height Array of Balanced Antipodal Vivaldi Antennas (BAVA) with Greater than Octave Bandwidth," Antenna Applications Symposium, Allerton Park, Monticello, Ill., pp. 226-242, 21-23 Sep., 2005.). The studies showed impedance anomalies occurring throughout the desired band that vastly limit the bandwidth of the array. Their studies led to solutions that allowed the anomalies to be controlled sufficiently for improved bandwidth, such as mirroring of elements in the E and H plane (called double mirroring) and placing slots in the fin layers, as described in the US Patent Application Publication 2008/02111726 (the DmBAVA-MAS), and a PhD thesis (M. W. Elsallal, "Doubly-Mirrored Balanced Antipodal Vivaldi Antenna (DmBAVA) for High Performance Arrays of Electrically Short, Modular Elements," PhD dissertation, Electrical and Computer Engineering, Univ. of Massachusetts, February 2008). Among these advancements, the double mirroring is the key development that enables wideband operation. The BAVA achieves a wide bandwidth, low profile, and modularity, but requires a balun (180° hybrid) in the feed network. FIG. 1 shows the required phase shifter 23 with the DmBAVA that comprises a number of elements, each element including fin 1 and fin 2. Two adjacent elements are fed at opposite polarities using phase shifter 23.

A development similar to the BAVA is the bunny ear element, developed by J. J Lee (Lee, J. J., et al., "Wide Band Bunny-Ear Radiating Element," Antennas and Propagation Society International Symposium, AP-S Digest, pp. 1604-1607, 1993, and U.S. Pat. No. 5,428,364). The element consists of a dielectric slab with a tapered slotline printed on each side that transitions from a narrow slot at the ground plane to a wide slot at the radiating aperture. The ground plane of the slotline is shaped into fins, with a narrow fin at the ground plane and a wide fin at the aperture. The element achieves wide bandwidth, is low profile, and is modular, but requires a balun embedded in the element, which increases the cost and complexity of fabrication.

The Bunny Ear Element is a balanced structure very similar to the dipole element, which has found extensive application in narrowband antenna arrays. The dipoles are low profile and modular, but the dipole is a balanced structure that also requires a balun in order to connect to standard RF interfaces. Thus the balun is a major design challenge, and much work has been done on the balun implementation. U.S. Pat. No. 3,747,114 issued to Shyhalla shows a dipole array with baluns printed on the backplane, with the balun consisting of phase delay lines between the balanced feed pins of the dipole elements. U.S. Pat. No. 6,512,487 issued to Taylor et al shows a dipole layer fed by balanced vertical feed pins, requiring an external balun. US Patent Application Publication US 2007/0222696 (Wikstrom et al.) and US Patent Application Publication US 2009/0051619 (Hook et al.) also involve arrays of dipoles fed directly by balanced transmission lines, requiring external baluns.

The necessity of the balun has led to much interest in developing integrated balun structures. One example is U.S. Pat. No. 3,845,490 issued to Manwarren et al, which shows a stripline dipole structure fed by an "L" shaped transmission line embedded between the dipole layers, forming a balun structure. U.S. Pat. No. 4,825,220 issued to Edward et al showed the use of a "J" shaped microstrip line feeding a microstrip dipole structure. U.S. Pat. No. 5,892,486 issued to Cook et al. also incorporated a "J" shaped microstrip line feeding a microstrip dipole where the "J" shaped balun extended above the dipoles. Each of these designs uses a balun consisting of an open circuited feed line proximity coupled to the dipole structure.

SUMMARY

The antenna element is a lightweight, low cost, low profile, modular array element suitable for single and dual polarized arrays that achieves wideband performance without the use of a balun or an impedance matching network. The antenna element can be used in a modular wideband antenna array. The antenna element fills a gap in the current UWB element technology by simultaneously achieving wideband performance, low cost fabrication, modular and low profile elements, and direct feeding from standard RF interfaces without the need for a balun. While other UWB elements exist that achieve some of these characteristics, none of the current technologies achieve all of these advantageous properties at once.

The invention features an antenna which operates over a wide bandwidth in an array environment. The antenna elements can be used in both single and dual polarized array configurations, can have completely modular fabrication without electrical or mechanical connection between neighboring elements, and can directly interface with standard feed architectures since they do not require a balun. The elements are simple to fabricate, lightweight, and low profile.

The structure consists of somewhat vertical fins, which flare from a narrow feed line at the ground plane to arms oriented somewhat horizontally over a ground plane with a height of approximately $\lambda/4$ at the middle of the band ($\lambda/2$ at the highest frequency). One fin of the element (one arm) is connected to the feed network, and the other fin is connected to the ground plane. The fins are tapered and act as an impedance transformer to match the high impedance of the flared arms to the 50Ω RF interface at the ground plane, which could be a feed network or transmit/receive modules. Spacing in the E and H plane of the array is chosen to be less than $\lambda/2$ at the highest frequency in the operating band to avoid grating lobes, and the element width is typically close to the element spacing. This allows the capacitive coupling between elements to be large, which is one of the tuning mechanisms that allows for high bandwidth operation.

One aspect that allows for wide bandwidth operation is the addition of metal traces connecting each of the fins to the ground plane. Without the traces, a common mode develops on the fins near the middle of the operating band, which manifests itself as a short circuit that essentially splits the operating band, drastically reducing the usable bandwidth. The metallic traces move the frequency of the common mode completely out of the operating band, allowing two octaves of bandwidth to be obtained. These traces are printed on the same layer as the fins, making them a simple and low cost solution of the problematic common mode.

Another aspect is the single metallization layer. This simplifies fabrication and reduces the cost of the element. This single layer topology does not suffer from the high cross polarization of the AVA, yet is much simpler than the BAVA.

The antenna array elements can be implemented in various forms, each of which offers distinct advantages in performance and manufacturability. The first implementation forms the two fins as thick metal elements without any dielectric material. The second implementation is a microstrip structure with a single printed layer on one side of a dielectric slab. The third implementation is the preferred embodiment of a single printed layer placed between two dielectric slabs. The fourth implementation is that of the AVA structure, where one fin is printed on one side of a dielectric slab, and one fin is printed on the other side of the dielectric. The fifth implementation is of a BAVA, or stripline structure, where one fin is the inner conductor between two dielectric slabs, and the other fin is implemented as two identical fins on the exterior of the dielectric slabs.

The antenna array element fills a gap in the current UWB array element technology by simultaneously achieving:

- Wideband performance
- Simple, low cost fabrication
- Lightweight construction
- Modular and low profile elements
- Single and dual polarized configurations
- Direct feeding from standard RF interfaces (no balun is required, and no impedance matching network is required).

While other UWB array elements exist that achieve some of these characteristics, none of the current technologies achieve all of these properties at the same time.

This antenna is able to achieve this performance due in part to the use of metallic strips connecting the fins to the ground plane, and the use of a single metalized layer.

The use of the metallic strips overcomes a significant hurdle in obtaining wide bandwidth from modular, electrically short flared elements. Previously, Elsallal had documented the DmBAVA as a solution to the common mode impedance anomaly, successfully moving the anomaly completely out of the operating band to attain a 4:1 bandwidth. This approach required neighboring elements to be mirrored in both the E and H plane (double mirroring), and as a result the electrical phasing between these elements must include 180° to ensure that the fields in the aperture plane are in phase, shown in FIG. 1A. Practically, the addition of this extra 180° phase shift between elements is difficult to implement over a wide bandwidth and at high frequencies. The phase shifters are lossy and expensive, and they increase the complexity and overall size of the feed network. The DmBAVA is the most promising element in the prior art for low profile, modular wideband array elements.

The BABTA, an embodiment of the antenna, eliminates the need for 180° of electrical phase shift between adjacent elements, wherein the elements are fed directly from an unbalanced transmission line (a typical RF interface). The metallic strips allow wideband operation without any balun structure, which drastically reduces the cost of the array and complexity of fabrication. The metallic strips do not add to the complexity or cost of the array since they only require printing extra features on the layers already containing the fins. The metallic strips have been used to successfully design single and dual polarized BABTA arrays with modular elements having a bandwidth of 4:1.

In addition to requiring a balun, many prior art elements—such as dipoles—also require impedance matching networks to match the elements to a standard RF interface, The inventive antenna does not require a matching network, as its feed line impedance at the ground plane is tuned to match standard RF interfaces.

Another aspect is the single layer topology utilized in the preferred embodiment of the antenna array elements, which further reduces the cost and complexity of fabrication significantly. Vivaldi elements and Bunny Ear elements are multilayer topologies that are difficult to fabricate. Also, the BAVA element is a three-layer structure requiring careful alignment of printed features on three different layers with plated vias connecting the outer fins, whereas the preferred embodiment of the element has only one layer of metallization. Using this single layer technology, antenna array elements have been designed to have bandwidths of over 4:1.

Both of these new topological advances—the metallic strips and the single layer construction—can be combined in the element to form a very low cost, low profile, modular, wideband antenna array that is very simple to fabricate.

The invention features a modular wideband antenna element for connection to a feed network, comprising a ground plane, first and second flared fins each defining a connection location that is relatively close to the ground plane and tapering to a free end located farther from the ground plane, wherein the connection location of the first fin is directly coupled to the feed network and the connection location of the second fin is directly coupled to the ground plane, one or more first traces electrically connecting the first fin to the ground plane and one or more second traces electrically connecting the second fin to the ground plane.

The fins and the traces may comprise a single metallization layer. The metallization layer may be located on a face of a dielectric layer. The metallization layer may be located between faces of two dielectric layers that are oriented face-to-face. The first fin and the first traces may comprise a single metallization layer and the second fin may comprise a pair of identical fin elements separated by a dielectric and electrically connected by one or more vias passing through the dielectric, and the second traces may comprise traces connected to each such fin element.

The fins may each define an outer taper that flares exponentially from the free end to the connection location and is closest to the ground plane, and further define an inner taper that flares exponentially from the free end to the connection location and is farthest from the ground plane. The traces may be coupled to the outer taper and may be substantially vertical. The traces may be coupled to the outer taper and may be angled. The traces may be coupled to the outer taper and may meander. The traces may be coupled to the outer taper and may be of substantially equal width.

The modular wideband antenna element may comprise at least two traces connected to each fin. The modular wideband antenna element may further comprise a lumped impedance in series with the traces. The first fin and first traces may be located on a first face of a dielectric layer and the second fin and second traces may be located on a second face of the dielectric layer, the two faces of the dielectric being parallel. The fins and traces can be made from thick solid metal.

The invention also features an antenna array comprising a plurality of the described antenna elements. The antenna array may be a single polarized array in which the fins of the antenna elements are located in a plurality of parallel planes, or may be a dual polarized array in which the fins of one group of antenna elements are located in a plurality of first parallel planes and the fins of another group of antenna elements are located in a plurality of second parallel planes that are orthogonal to first parallel planes.

Further featured is a modular wideband antenna array for connection to a feed network, comprising a plurality of antenna elements. Each antenna element comprises a ground plane and first and second flared fins above the ground plane and each defining a connection location that is relatively close to the ground plane and tapering to a free end located farther from the ground plane, wherein the connection location of the first fin is directly coupled to the feed network and the connection location of the second fin is directly coupled to the ground plane, in which the fins each define an outer taper that flares exponentially from the free end to the connection location and is closest to the ground plane, and further define an inner taper that flares exponentially from the free end to the connection location and is farthest from the ground plane. There are one or more first substantially vertical traces electrically connecting the outer taper of the first fin to the ground plane and one or more second substantially vertical traces electrically connecting the outer taper of the second fin to the ground plane. The fins and the traces comprise a single metallization layer. The antenna elements are arranged as a single polarized array in which the fins of the antenna elements are located in a plurality of parallel planes.

Still further featured is a modular wideband antenna array for connection to a feed network, comprising a plurality of antenna elements. Each antenna element comprises a ground plane and first and second flared fins above the ground plane and each defining a connection location that is relatively close to the ground plane and tapering to a free end located farther from the ground plane, wherein the connection location of the first fin is directly coupled to the feed network and the connection location of the second fin is directly coupled to the ground plane, in which the fins each define an outer taper that flares exponentially from the free end to the connection location and is closest to the ground plane, and further define an inner taper that flares exponentially from the free end to the connection location and is farthest from the ground plane. There are one or more first substantially vertical traces electrically connecting the outer taper of the first fin to the ground plane and one or more second substantially vertical traces electrically connecting the outer taper of the second fin to the ground plane. The fins and the traces comprise a single metallization layer. The antenna elements are arranged as a dual polarized array in which the fins of one group of antenna elements are located in a plurality of first parallel planes and the fins of another group of antenna elements are located in a plurality of second parallel planes that are orthogonal to first parallel planes.

BRIEF DESCRIPTION OF THE DRAWINGS

FIG. 5—4×4 element array of dual-polarized elements.

DETAILED DESCRIPTION OF EMBODIMENTS

Figure 1:
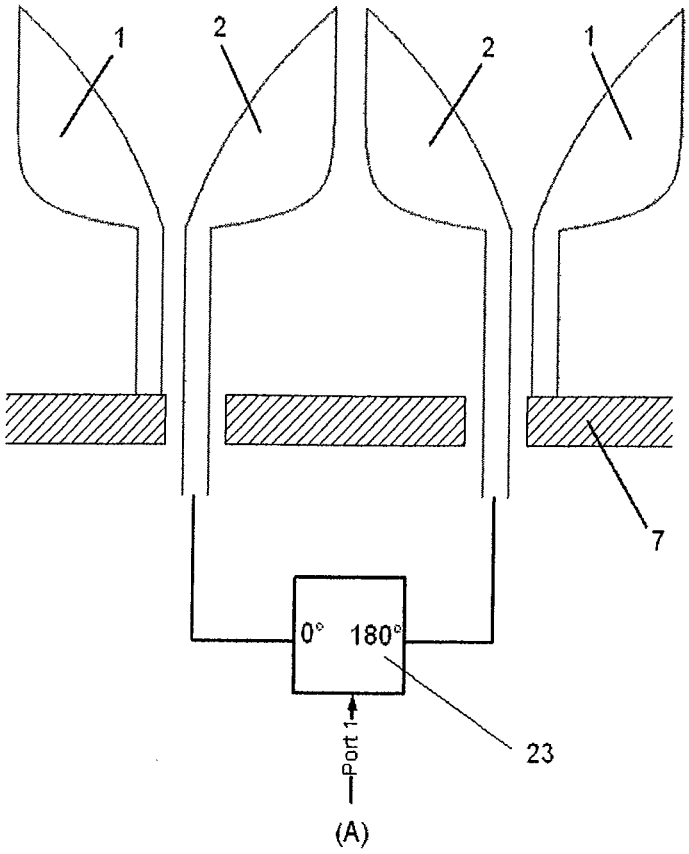
Figure 1 Prior Art
FIG. 1—Feed circuitry required for prior art mirrored elements.
Figure 2:
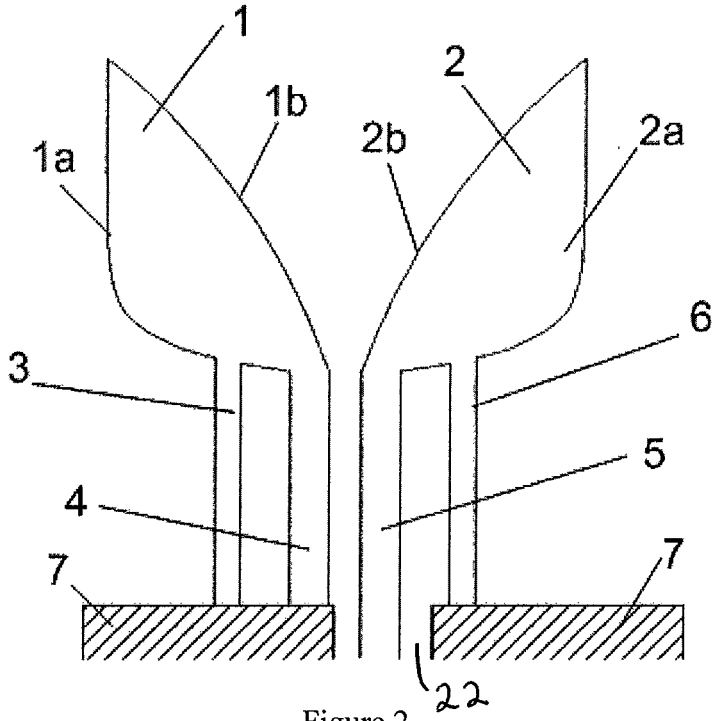
FIG. 2—Topology of an antenna element.

The topology of the preferred element embodiment is shown in FIG. 2, and comprises two flared fins or arms. One flared metal fin 1 has an outer taper 1*a* that flares exponentially from the top or distal end of the fin to the bottom of the fin, and it has an inner flare 1*b* that tapers exponentially from the top of the fin to the bottom of the fin. A second tapered metal fin 2 has an outer taper 2*a* with the same exponential taper as 1*a*, and an inner taper 2*b* that has the same exponential taper as 1*b*. The inner tapers 1*b* and 2*b* enhance the impedance match of the element, allowing control over mainly the resistance of the element. These tapers can also be viewed as a radiating tapered slot, with the slot defined as the air gap between tapers 1*b* and 2*b*. Tapers 1*a* and 2*a* also impact the impedance, but also control the size of the fins, where the taper can be adjusted to produce fins with large or small surface areas, and, consequently, they also impact the strength of the coupling between neighboring elements. Note that the tapers are not limited to exponential tapers, and other tapers can be implemented such as linear and Klopfenstein taper profiles.

At the ground plane 7, a hole 22 in the ground plane (FIGS. 2-5) allows an unbalanced transmission line below the ground plane to be directly connected to vertical metal strip 5. This unbalanced line, which can take the form of coaxial cable, microstrip or stripline, constitutes the feed network of the array. The metal strip 5 has an adjustable width, and a length that extends from the ground plane up to the base or connection location of fin 2. Located parallel to the driven metal strip 5, a second metal strip 4 is connected directly to ground on one end, and is connected to the base of fin 1 on the other. Metal strips 4 and 5 form an unbalanced TEM two-conductor transmission line that brings the excitation signal from the ground plane up to fins 1 and 2. The width of metal strips 4 and 5 and their separation define the characteristic impedance of the feed line.

Metallic strips 3 and 6 are added to the arms. Metallic strip 3 is connected on one end to fin 1 along taper 1*a*, and is connected to the ground plane 7 on the other end. A second vertical strip 6 is connected on one end to fin 2 along its outer taper 2*a*, and is connected to the ground plane 7 on the other end. Metallic strips 3 and 6 have widths that can be adjusted to tune the impedance performance. The separation of metallic traces 3 and 4, and also the separation between metallic traces 5 and 6 can be adjusted to change the impedance behavior of the element.

Figure 4:
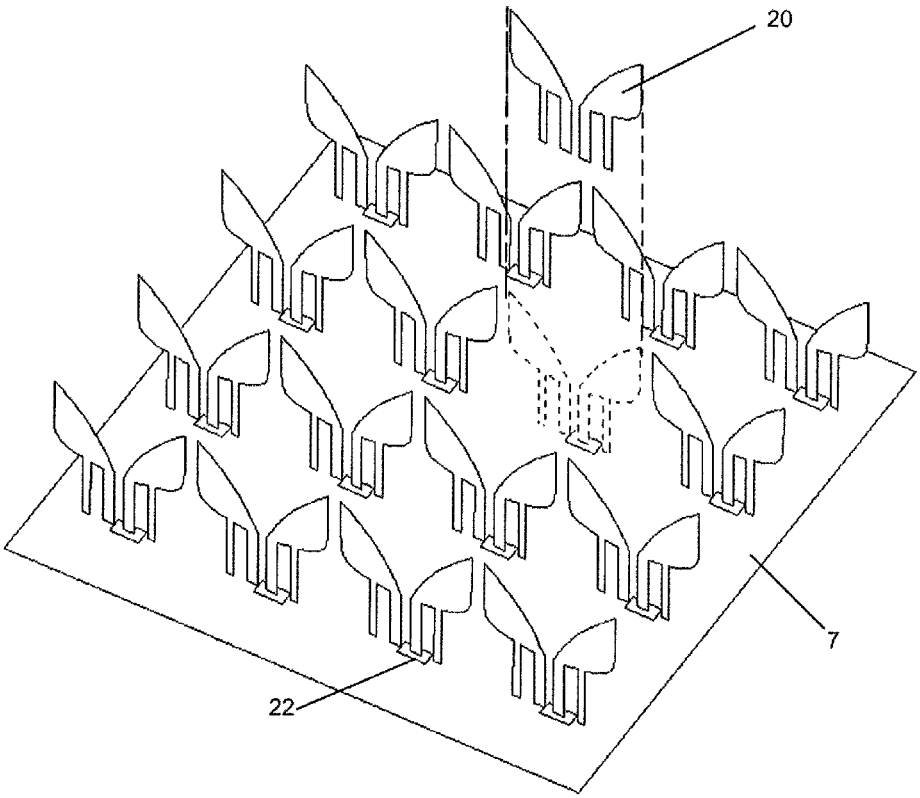
FIG. 4—4×4 element array of single-polarized elements.
Figure 5:
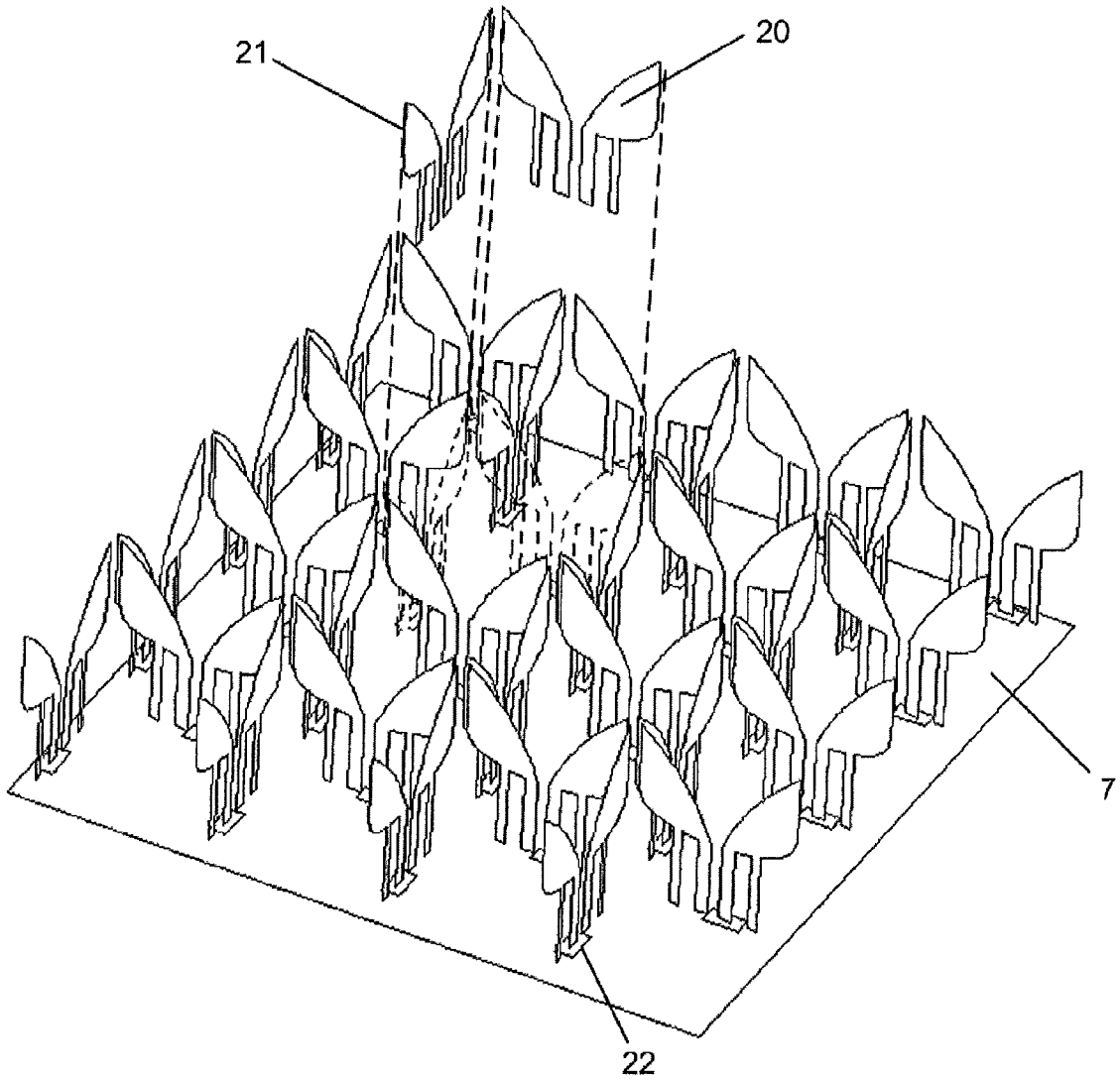
Figure 23:
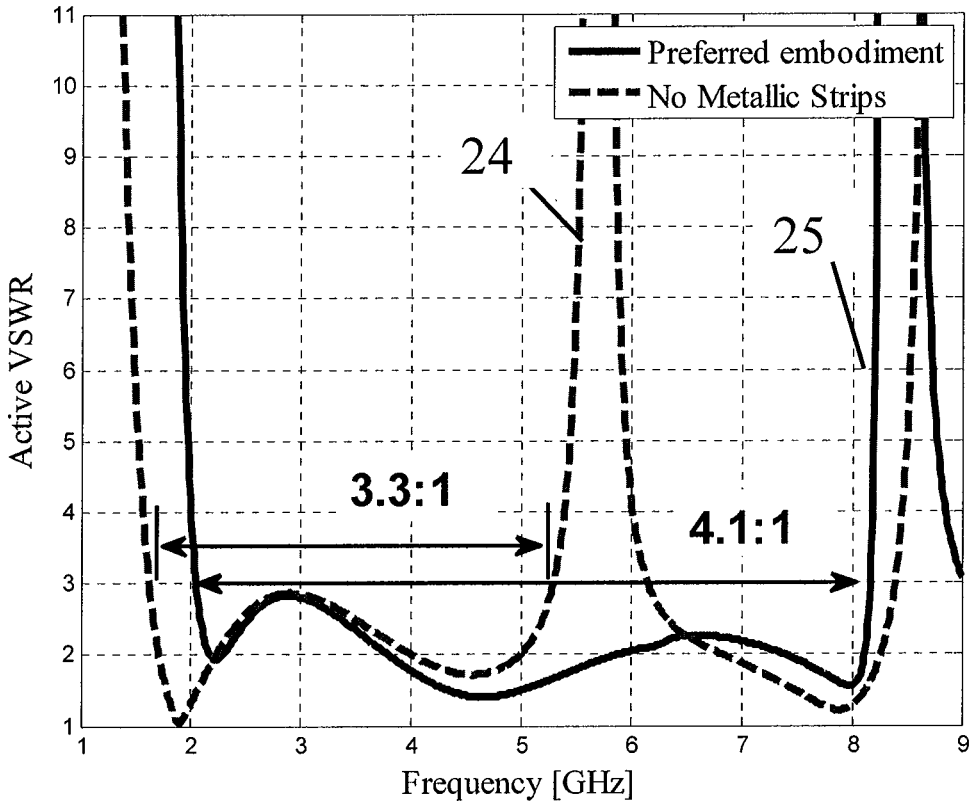
FIG. 23—Predicted broadside VSWR of the single polarized antenna with and without metallic strips. H plane spacing is ¾ that of the E plane spacing.

A benefit of metallic strips 3 and 6 can be seen in FIG. 23, where elements are arranged in a single polarized array as shown in FIG. 4, in which the fins of each element 20 lie in parallel planes. A dual-polarized embodiment, FIG. 5, adds elements 21 that lie in orthogonal planes that are located in the spaces between elements 20.

The predicted broadside VSWR performance for a single polarized array is shown in FIG. 23, which compares the performance of the preferred embodiment of the antenna array with an identical geometry without metallic strips 3 and 6. The elements are approximately one quarter wavelength long at midband (4 GHz), with a substrate thickness on the order of ¼ wavelength. The feed stems (strips 4 and 5) have a length of about 1/10 of a wavelength at midband, and have a width of about 1/50 of a wavelength. The metallic strips 3 and 6 are located about 1/16 of a wavelength at midband from the feed stem, have a height about ⅛ of a wavelength, and have a width of approximately 1/300 of a wavelength. The E plane element spacing is approximately one quarter wavelength at midband, and the H plane spacing about ¾ that of the E plane spacing. The metallic strips 3 and 6 are shown to increase the 3:1 VSWR bandwidth from 3.3:1 for the BTA without metallic strips, curve 24, to 4.1:1 for the BTA, curve 25. The anomaly near 6 GHz in curve 24 is moved beyond the highest frequency in the operating band. The metallic strips 3 and 6 provide a means of controlling the position of the anomaly in the frequency band, where the size and location of metallic strips 3 and 6 dictate the frequency at which the anomaly occurs.

Figure 24:
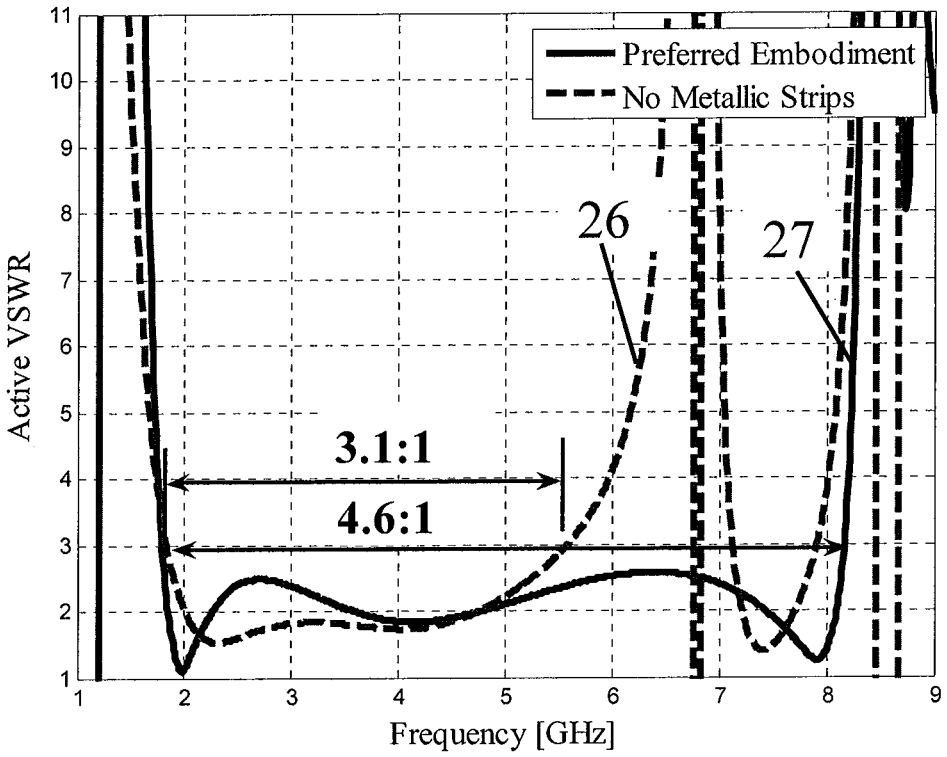
FIG. 24—Predicted broadside VSWR of the dual polarized antenna with metallic strips. Equal E and H plane spacings.

The predicted broadside VSWR performance for a dual polarized array (such as that of FIG. 5) is shown in FIG. 24, where the array has equal spacing of approximately one quarter wavelength at midband in both the E and H planes. The elements are approximately one quarter wavelength long at midband (4 GHz), with a substrate thickness on the order of ¼ wavelength. The feed stems (strips 4 and 5) have a length of about 1/10 of a wavelength at midband, and have a width of about 1/50 of a wavelength. The metallic strips 3 and 6 are located about 1/22 of a wavelength at midband from the feed stem, have a height of about ⅛ of a wavelength, and have a width of approximately 1/150 of a wavelength. The 3:1 VSWR bandwidth is shown to increase from 3.1:1 for the BTA without metallic strips, curve 26, to 4.6:1 for the BTA, curve 27, due to metallic strips 3 and 6. Thus the antenna is able to achieve two octaves of bandwidth with a single metalized layer and without a balun.

Certain Embodiments

Figure 3:
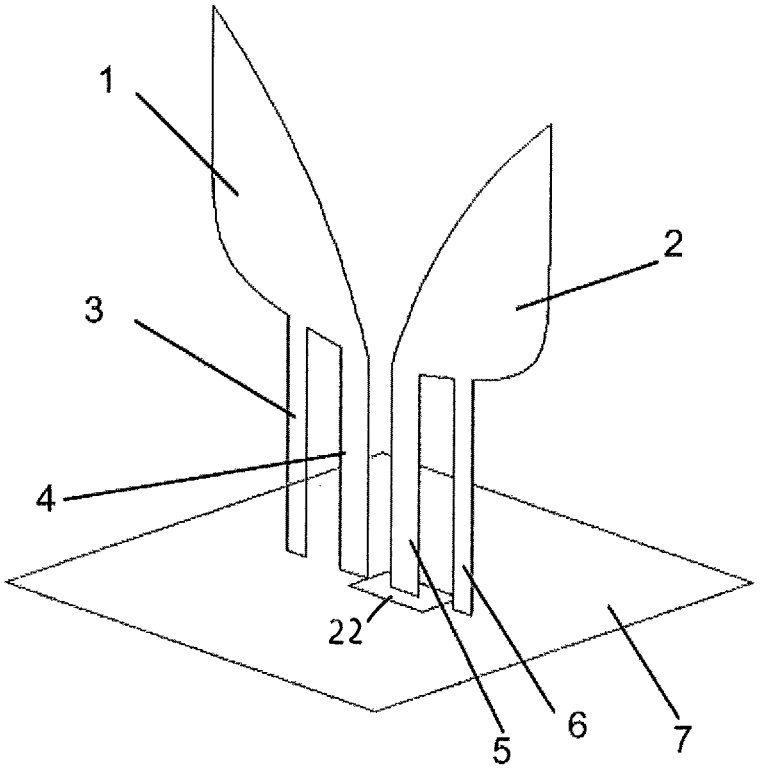
FIG. 3—Isometric view of the antenna element of FIG. 2.
Figure 15:
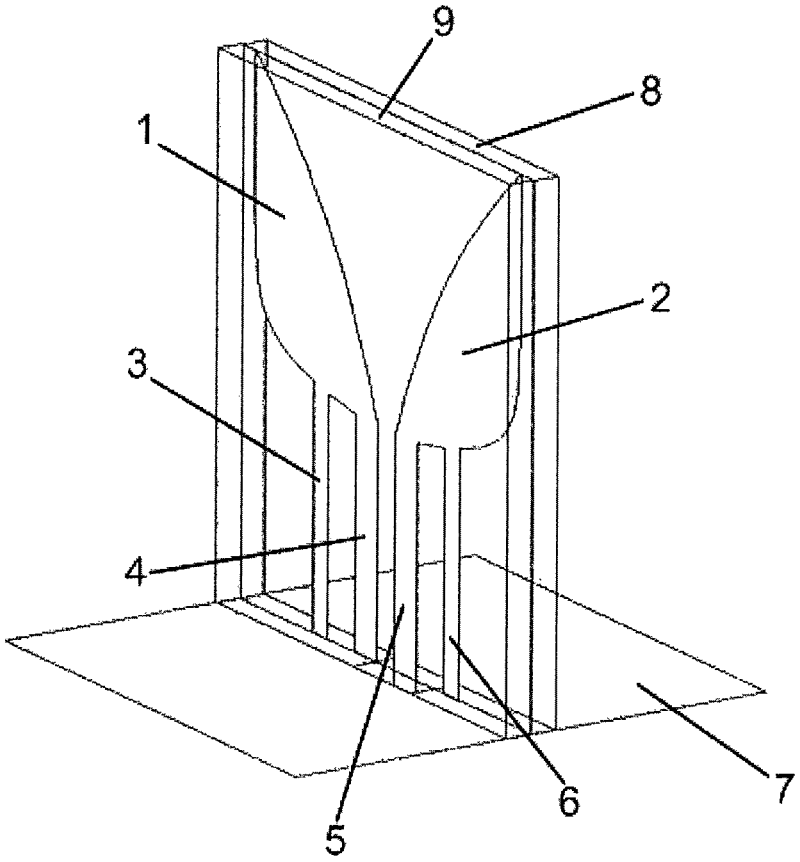
FIG. 15—Isometric view of preferred element embodiment.
Figure 16:
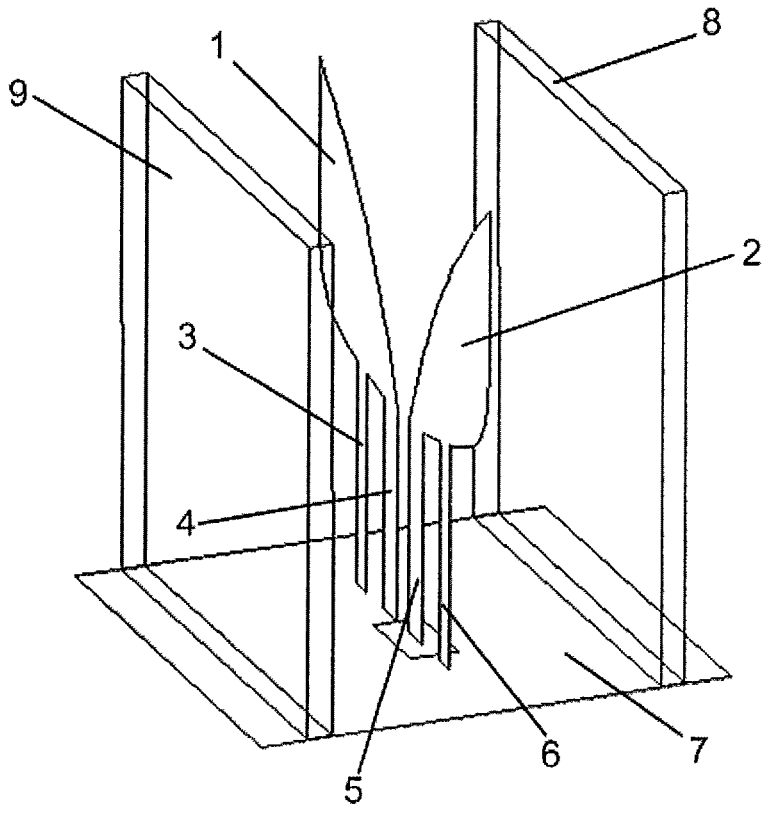
FIG. 16—Exploded view of the preferred embodiment of the element of FIG. 15.

The preferred embodiment of the antenna element is shown in FIGS. 15 and 16, which is the same geometry described in FIGS. 2 and 3 with the addition of dielectric layers 8 and 9 on either side of the metal layer. Dielectric layers 8 and 9 can take two forms: continuous slabs with subarrays, or entire rows of elements, fabricated on a single dielectric layer; or as separate dielectric slabs for each element, making the elements completely modular in both single and dual polarized configurations. The dielectric slabs can also be extended vertically above the metal fins (not shown in the drawings) for tuning purposes. The element can be printed on one dielectric layer (8 or 9), with the other dielectric layer placed on top of the metal layer to form a sandwich structure. Mechanically, this structure allows the element to be easily printed onto a sturdy dielectric material, and the additional layer can be used to protect the element, as the two layers fully enclose the metal layer. Electrically, the two dielectric layers balance the structure by placing the fins in a symmetric dielectric slab, and the layers also add an extra degree of freedom in tuning via the choice of the dielectric material's relative permittivity.

Figure 6:
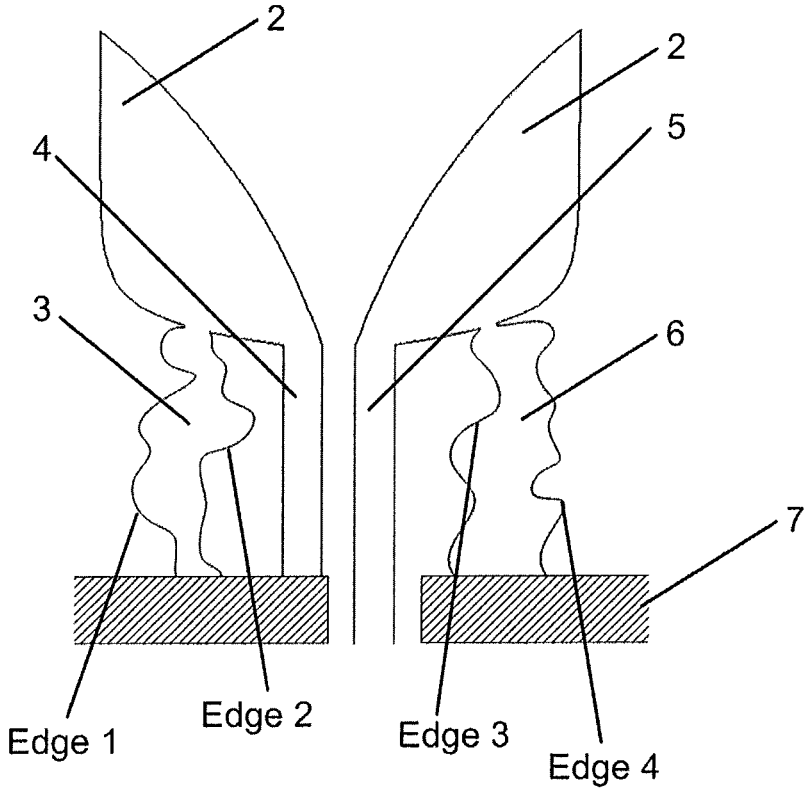
FIG. 6—Element with arbitrarily shaped metallic strips.

Metal strips 3 and 6 can take a variety of shapes and configurations that can apply to all of the technologies used to implement the fins, so the fin shapes will be considered first as dielectric-free single layer elements. The shape of the vertical metallic strips is not limited to rectangular shapes having straight edges. FIG. 6 shows an element with the vertical metallic strips comprised of arbitrary edge shapes, labeled as Edges 1, 2, 3, and 4. These edges can be defined by a taper profile, such as an exponential or Klopfenstein taper, or they can be defined as any shape along the length of the metallic strips as long as the strip contacts the fin on one end and the ground plane on the other. The shape of each of the metallic strips also need not be the same for each fin, and the two edges on an individual strip may be different.

Figure 7:
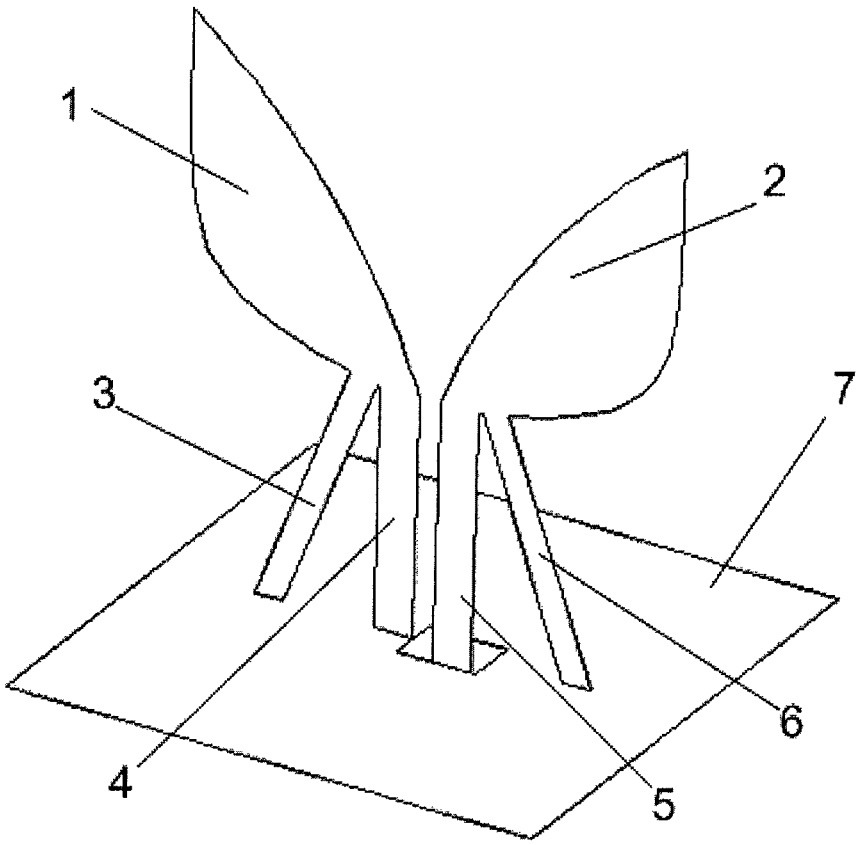
FIG. 7—Element with outward angled metallic strips.
Figure 8:
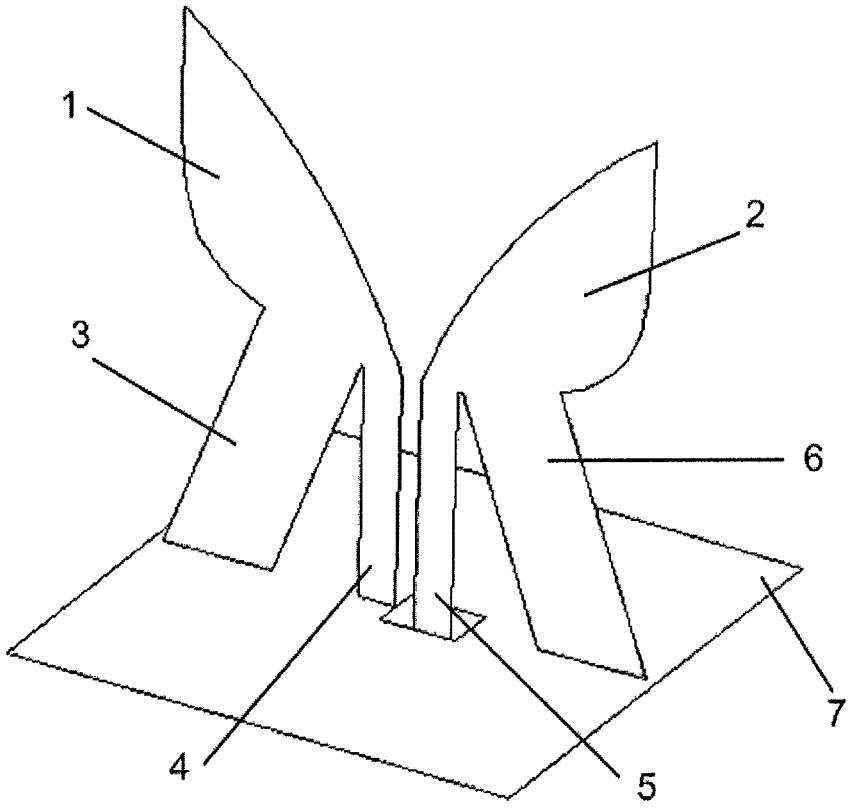
FIG. 8—Element with wide outward angled metallic strips.
Figure 9:
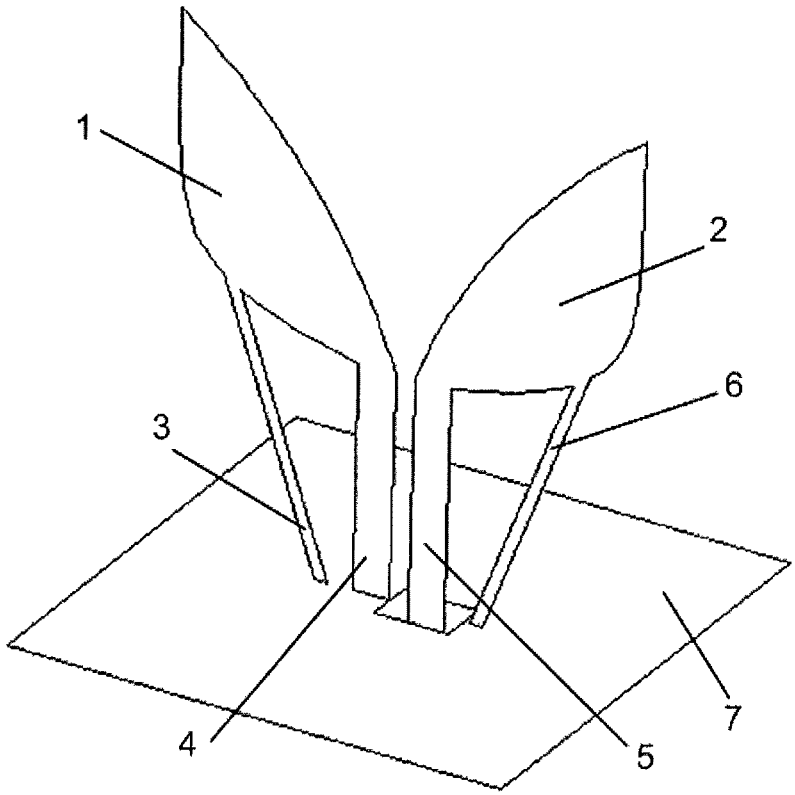
FIG. 9—Element with inward angled metallic strips.

The metallic strips 3 and 6 can take the form of strips angled outward from the fins to the ground plane, FIG. 7. The metallic strips 3 and 6 can also be very wide, FIG. 8, to adjust the reactance added by the metallic strips. The metallic strips 3 and 6 can also take the form of strips angled inward toward the fins, as shown in FIG. 9. This configuration allows variation in the location of the connection point between each of the metallic strips 3 and 6 and fins 1 and 2, as well as the location of the connection point between metallic strips 3 and 6 and ground 7. This is important because the position of metal traces 3 and 6 along the fin strongly impacts the inductance of the element. These shape adjustments to the metallic strips 3 and 6 can be used to tune the impedance behavior of the element.

Figure 10:
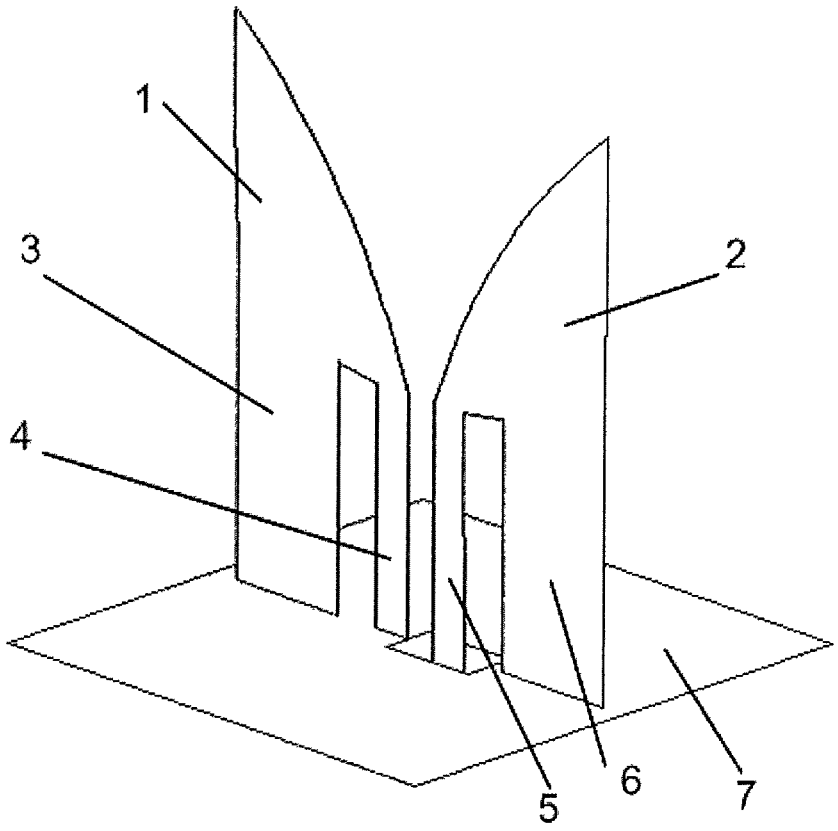
FIG. 10—Element with wide vertical metallic strips.

Metallic strips 3 and 6 can be made very wide, such that the elements have flat outer edges instead of a taper, and the width of the metallic strip creates two large fins 1 and 2, shown in FIG. 10. This wide metallic strip configuration essentially creates an inset feed out of metal strips 4 and 5. This allows adjustment of the coupling between neighboring elements.

Figure 11:
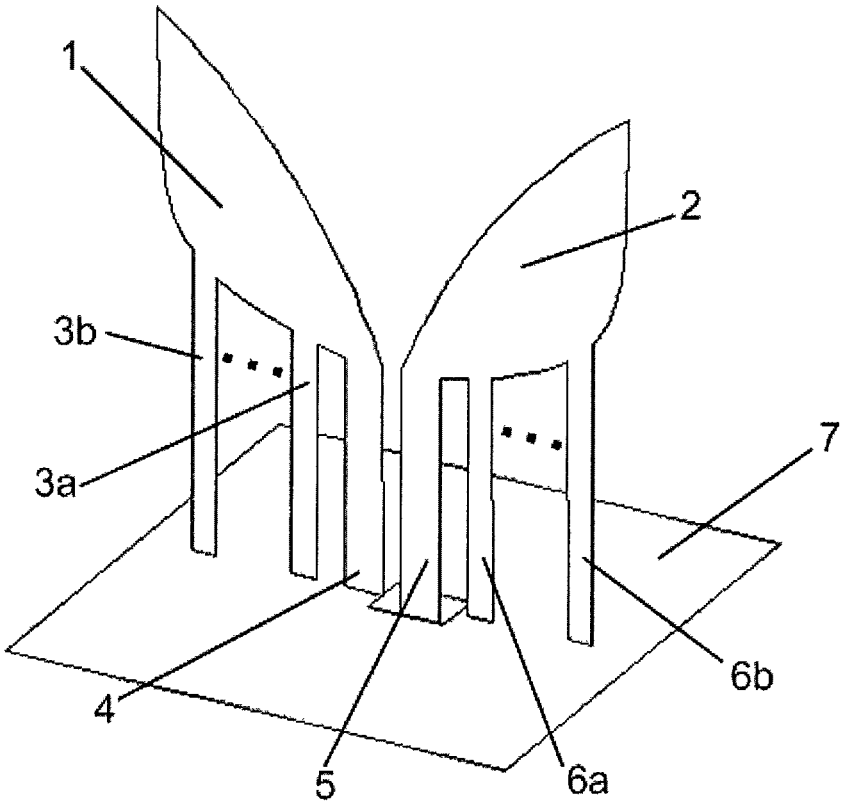
FIG. 11—Element with multiple vertical metallic strips per fin. The dots indicate the potential for additional strips in between those shown.

The element can also have two or more metallic strips per fin, FIG. 11, where fin 1 is connected to both metal strip 3*a* and 3*b*, and fin 2 is connected to metal strip 6*a* and 6*b*. The dots indicate an arbitrary number of metallic strips in between those explicitly shown. This configuration allows the element to have extra tuning degrees of freedom to provide for further adjustment of the impedance behavior.

Figure 12:
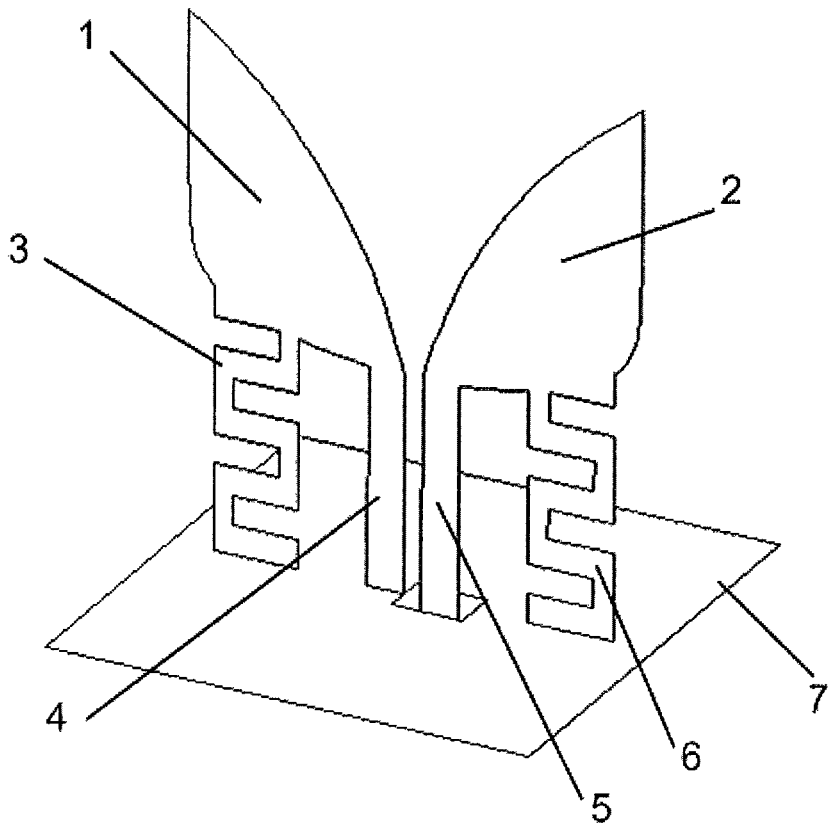
FIG. 12—Element with meandered metallic strips.

The metallic strips 3 and 6 are typically limited in length to the separation between the ground plane 7 and fins 1 and 2. The length of the metallic strips can be increased by meandering the metal strips, as shown in FIG. 12. This meandered line has a certain capacitance and inductance depending on the width, spacing, and length of the meander sections. This allows further control over the reactance introduced by the connection of the metal strips and fins 1 and 2.

Figure 13:
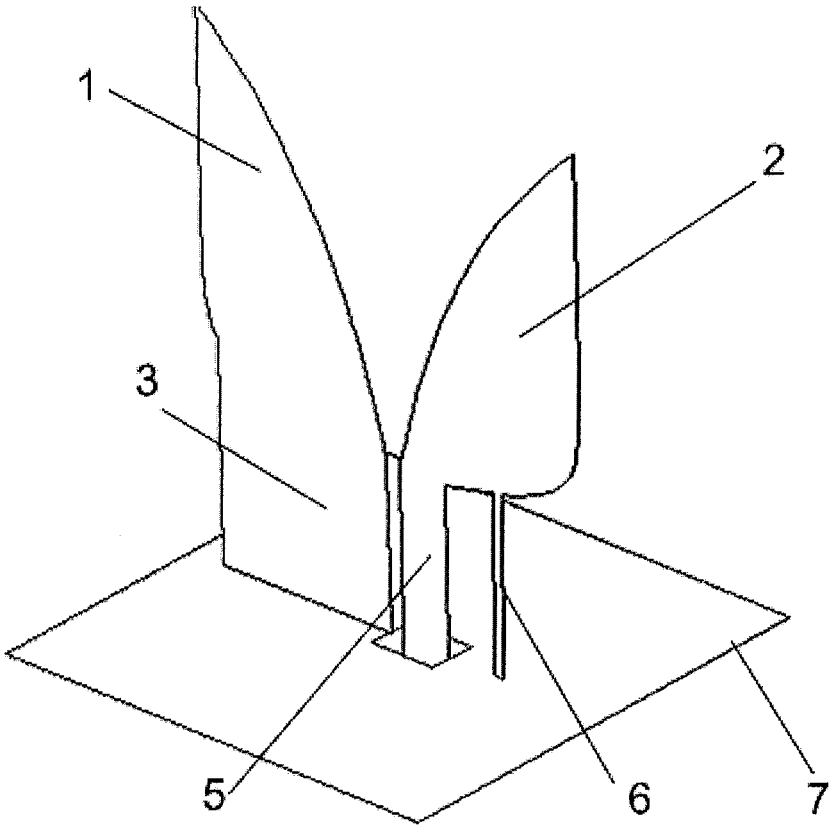
FIG. 13—Element with asymmetric vertical metallic strips.

The metallic strips 3 and 6 need not be identical and symmetric. FIG. 13 shows an element with a large width metal strip 3, which is large enough to merge with the vertical metal strip 4 (forming one conductor), and a narrow metal strip 6. This configuration provides a means of electrically counteracting the inherently unbalanced feed line with the design of the vertical metal strips 3 and 6.

Figure 14:
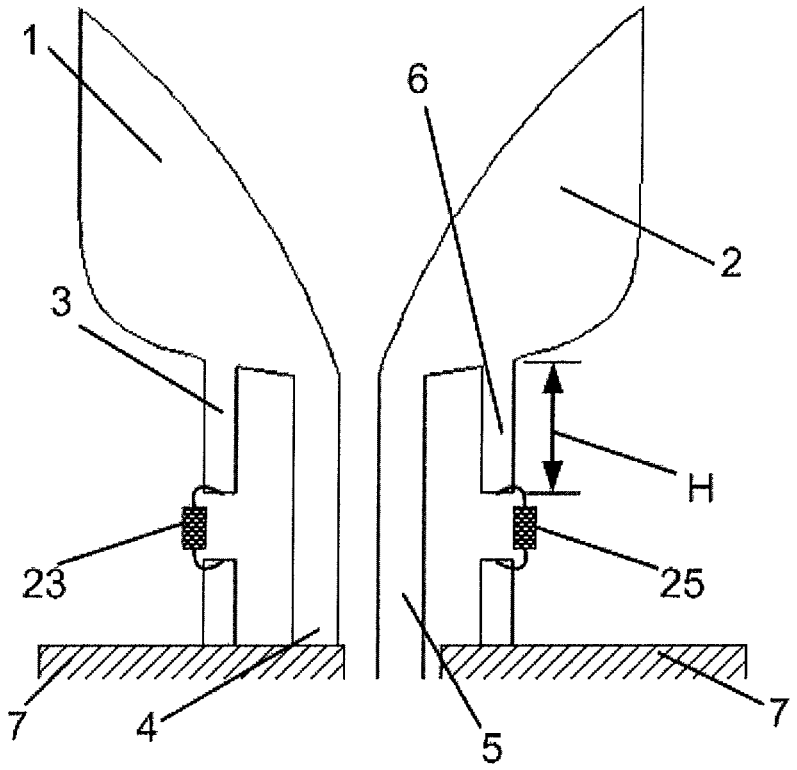
FIG. 14—Element with vertical metallic strips with lumped elements in series.

The metallic strips 3 and 6 can be modified with a lumped impedance to alter the tuning of the element. FIG. 14 shows lumped impedance 23 connected in series with one metallic trace 3, and lumped impedance 25 connected series with the other metallic strip 6. Each impedance is located at a distance H from the fins, which can be adjusted for both electrical and mechanical advantages, allowing an extra degree of freedom in tuning the impedance of the element, and allowing the impedances to be located for convenient fabrication. The lumped impedance can be any combination of series or parallel connections of resistors, capacitors, and/or inductors.

The remaining embodiments concern the implementation of the element in different manufacturing technologies including microstrip, stripline, and solid machined metal.

Figure 17:
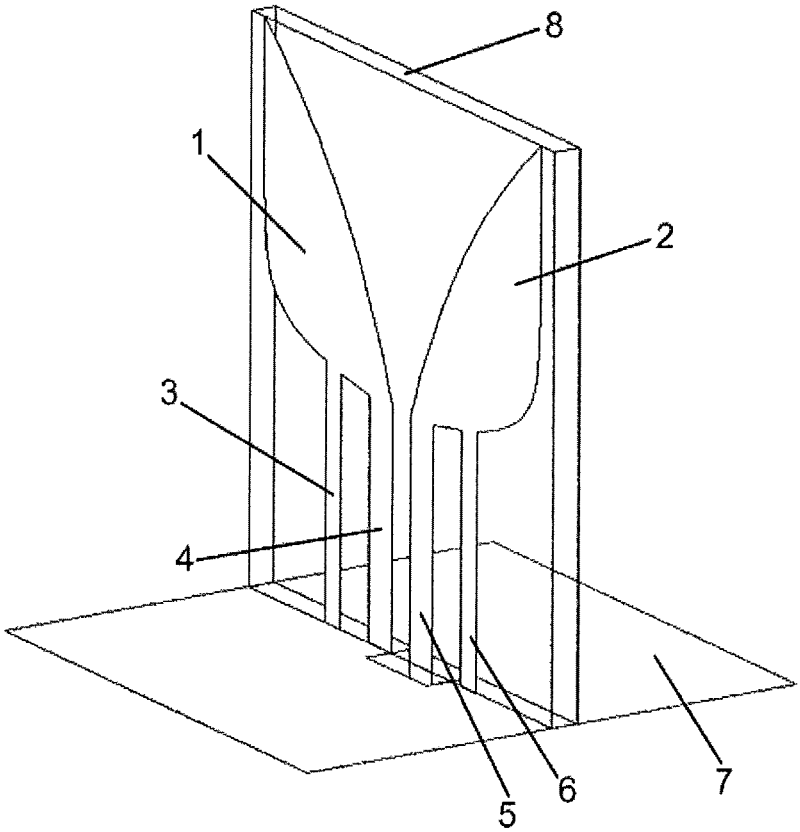
FIG. 17—Microstrip embodiment of the element.

The element can take the form of a microstrip structure, with the element printed on one side or face of a single dielectric slab 8, as shown in FIG. 17. This structure is simpler to implement and does not suffer from the shrinkage problems that occur when bonding two dielectric layers together. The design is particularly desirable for single polarized arrays where large modular cards of many elements are beneficial for both low cost and ease of fabrication.

Figure 18:
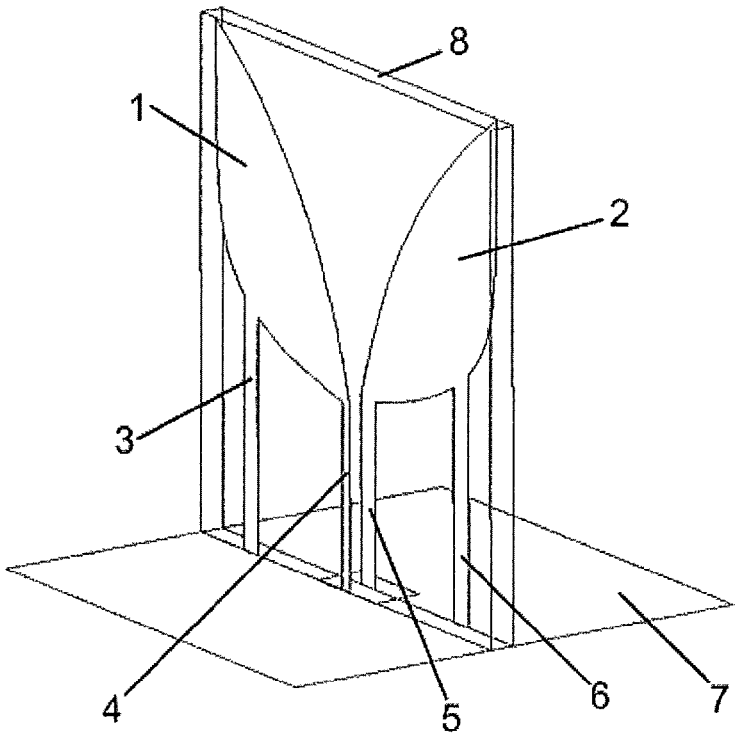
FIG. 18—Isometric view of the AVA embodiment of the element.
Figure 19:
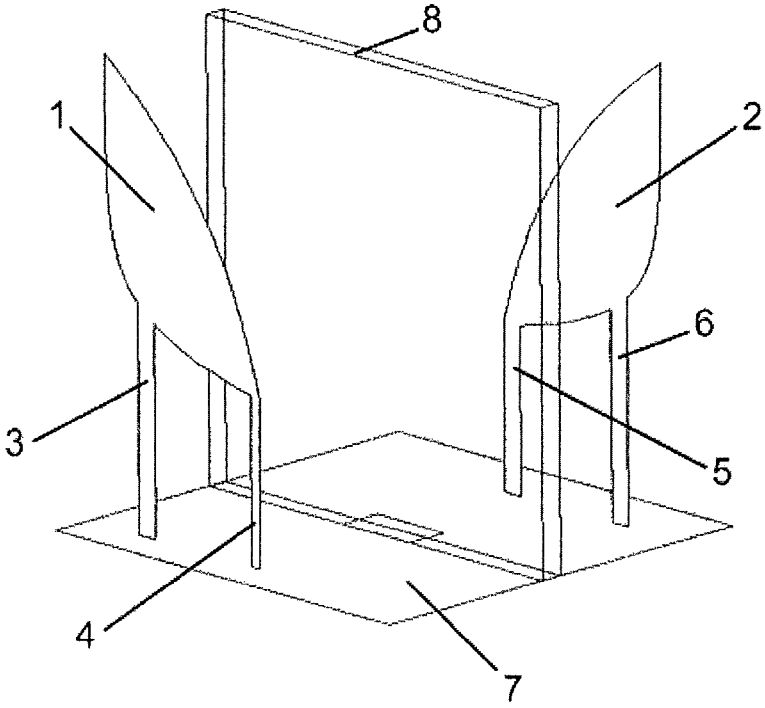
FIG. 19—Exploded view of the AVA embodiment of FIG. 18.

The element can also take the form of the Antipodal Vivaldi Antenna (AVA) structure, FIGS. 18 and 19. This element is the same as the microstrip embodiment of FIG. 17, except that fin 2, feedline 5 and metallic strip 6 are printed on the other side of the dielectric slab 8. This structure is simpler than the BAVA, with the two metal layers printed onto the sides of a single dielectric layer 8, and allows for a simple transition from a printed microstrip line.

Figure 20:
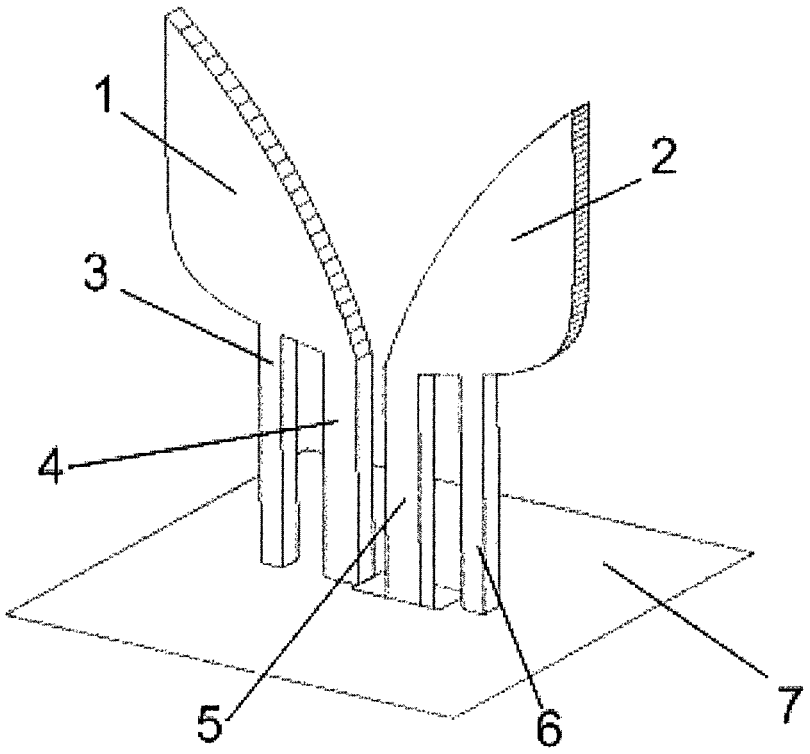
FIG. 20—Isometric view of the thick solid metal embodiment of the element.

The element can take the form of two solid metal elements, FIG. 20. The two fins 1 and 2, and the vertical metal strips 3, 4, 5 and 6 can be thick metal shapes without any dielectric material in the structure. The element features can be shaped out of one single block of metal, fabricated in separate pieces and then assembled and electrically connected, or shaped out of metal wire. This embodiment is preferred for low noise and high-power applications.

Figure 21:
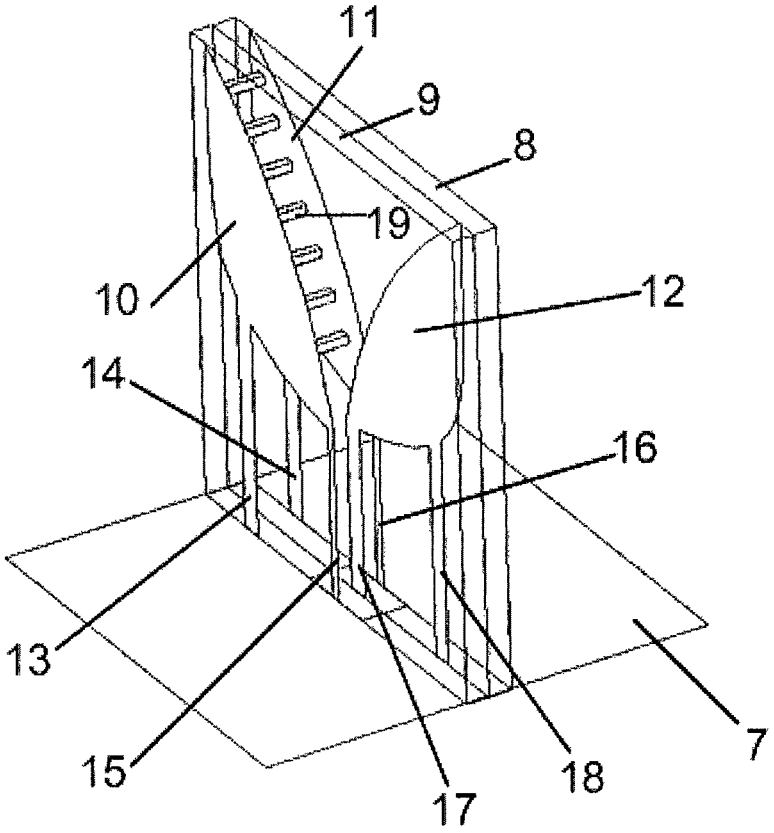
FIG. 21—Balanced Antipodal element embodiment.
Figure 22:
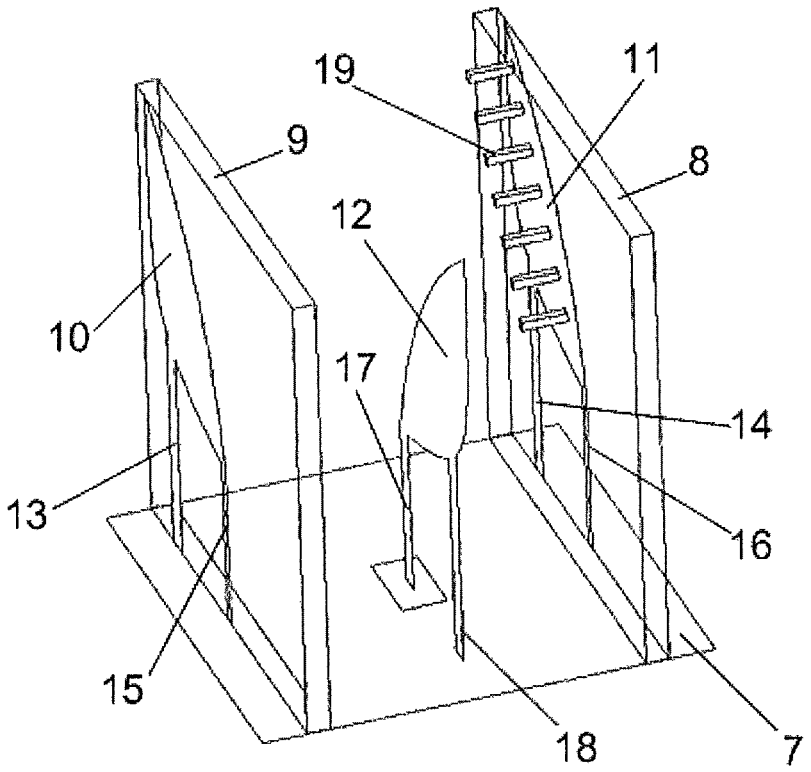
FIG. 22—Exploded view of the Balanced Antipodal embodiment of FIG. 21.

The element can take the form of a stripline structure based on the BAVA topology, termed the Balanced Antipodal Banyan Tree Antenna (BABTA) as shown in FIGS. 21 and 22. This BABTA topology consists of three metal layers, where one layer is centered between dielectric layers 8 and 9, with the two outermost metal layers identical. The inner layer consists of fin 12, which has the same taper features as described for fin 1 and 2. Also on the inner layer, a feed line 17 connects to the base of fin 12 on one end, and is excited by a transmission line at the ground plane on the opposite end. The vertical metallic strip 18 is connected along the outer taper of fin 12 on one end, and is connected to the ground plane on the opposite end. The outer layers contain fins 10 and 11, both of which have the same taper features as fins 1 and 2. Fins 10 and 11 are joined by a set of vias 19 passing through the dielectric that short the two fins together, which is done to suppress resonances that otherwise occur when scanning in the H plane of the element. The stripline structure is an unbalanced structure, where metal strips 15 and 16 are the grounded conductors and 17 is the excited line. Strips 13 and 14 are also grounded.

Figure 25:
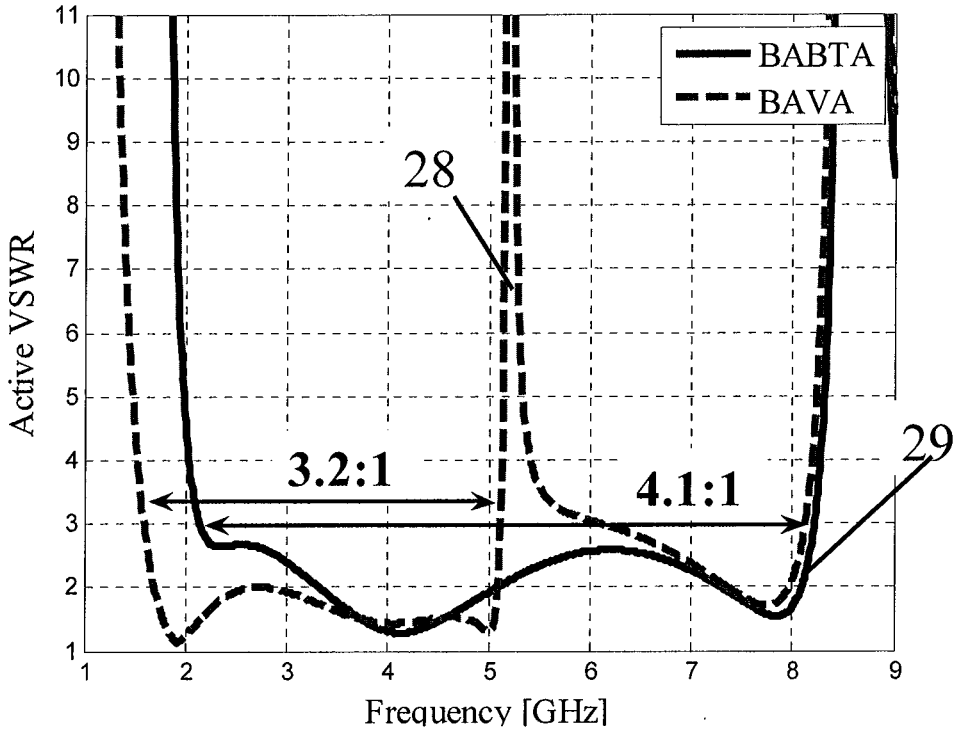
FIG. 25—Predicted broadside VSWR of a single polarized BAVA element and the BABTA element. H plane spacing is ¾ that of the E plane spacing.

The predicted broadside VSWR performance for a single polarized array of the BABTA is shown in FIG. 25. The two curves show the performance of identical elements, except that the BABTA, curve 29, has grounded metallic strips 13, 14 and 18, and the other element is a traditional BAVA element without such strips, curve 28. The elements are approximately one quarter wavelength long at midband (4 GHz), with a substrate thickness on the order of ¼ wavelength. The feed stems (strips 4 and 5) have a length of about 1/10 of a wavelength at midband, and have a width of about 1/75 of a wavelength. The metallic strips are located about 1/16 of a wavelength at midband from the feed stem, have a height of about ⅛ of a wavelength, and have a width of approximately 1/150 of a wavelength. The E plane element spacing is about one quarter wavelength at midband, and the H plane spacing about ¾ that of the E plane spacing. The 3:1 VSWR bandwidth of the element is increased from 3.2:1 to 4.1:1 due to the metallic strips, with the anomaly moved entirely out of the operating band.

Figure 26:
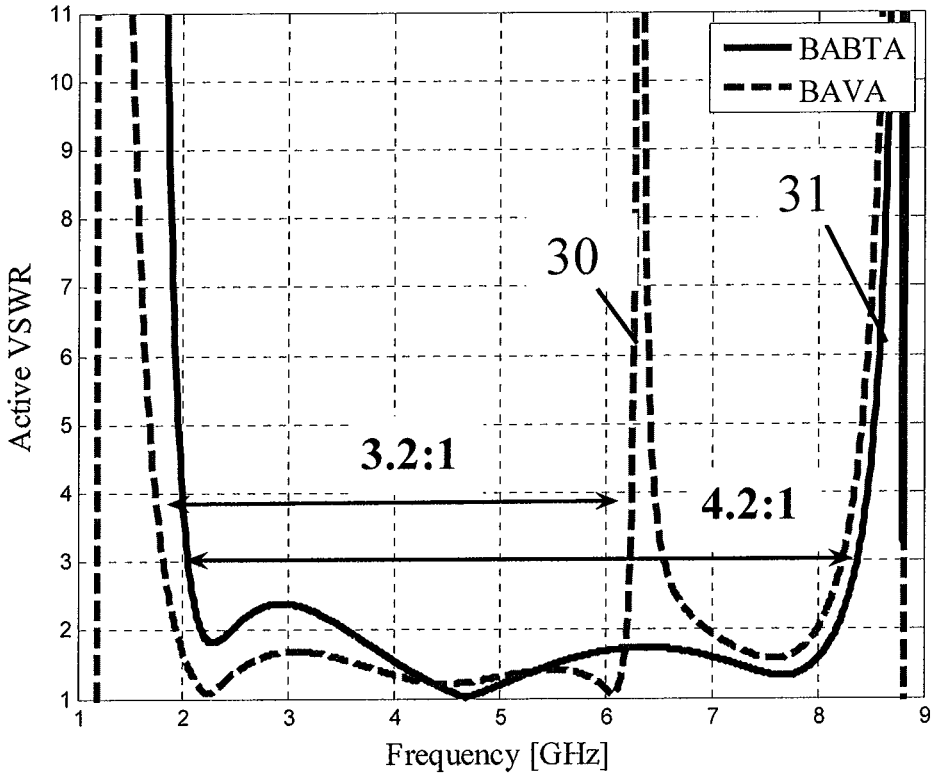
FIG. 26—Predicted broadside VSWR of a dual-polarized BAVA element and the BABTA element. Equal E and H plane spacings.

The predicted broadside VSWR performance for a dual polarized array of the BABTA is shown in FIG. 26. The elements are approximately one quarter wavelength long at midband (4 GHz), with a substrate thickness on the order of ¼ wavelength. The feed stems (strips 4 and 5) have a length of about 1/10 of a wavelength at midband, and have a width of about 1/75 of a wavelength. The metallic strips are located about 1/22 of a wavelength at midband from the feed stem, have a height of about ⅛ of a wavelength, and have a width of approximately 1/150 of a wavelength. The array has equal element spacing of approximately one quarter wavelength at midband in both the E and H planes. Once again, the 3:1 VSWR bandwidth of the BABTA, curve 31, is 4.2:1 compared to the BAVA bandwidth, curve 30, of 3.2:1. The BABTA structure achieves a bandwidth that was previously only possible by mirroring BAVA (DmBAVA) elements in the in the E and H plane of the array. By using metallic strips 13, 14, and 18 in the design, the BABTA elements do not require the differential feeding (balun) of the DmBAVA.

What is claimed:

1. A modular wideband antenna element for connection to a feed network, comprising:

a ground plane;

a first flared fin having an outer flare that tapers exponentially from the to of the fin to the bottom of the fin and an inner flare that tapers exponentially from the to of the fin to the bottom of the fin;

a second flared fin having an outer flare that tapers exponentially from the top of the fin to the bottom of the fin and an inner flare that tapers exponentially from the to of the fin to the bottom of the fin, wherein the inner flares of the first and second flared fins form a radiating tapered slot;

a base of the first fin is electrically connected to an unbalanced line of the feed network by a feed stem of the first fin that extends through the ground plane;

a base of the second fin is electrically connected to the ground plane by a ground stem of the second fin, wherein the feed stem and the ground stem form an unbalanced transverse electric and magnetic mode two conductor transmission line;

the base of the first fin is electrically connected to the ground plane by one or more grounding strips of the first fin; and the base of the second fin is electrically connected to the ground plane by one or more grounding strips of the second fin.

2. The modular wideband antenna element of claim 1 in which the first and second fins, the feed stem of the first fin, the ground stem of the second fin, and the one or more grounding strips of the first and second fins comprise a single metallization layer.

3. The modular wideband antenna element of claim 2 in which the metallization layer is located on a face of a dielectric layer.

4. The modular wideband antenna element of claim 2 in which the metallization layer is located between faces of two dielectric layers that are oriented face-to-face.

5. The modular wideband antenna element of claim 1 in which:

the first fin and the feed stem comprise a single metallization layer; and the second fin comprises a pair of identical fin elements separated by a dielectric and electrically connected by one or more vias passing through the dielectric, and the grounding strips comprise metallic strips connected to each such fin element.

6. The modular wideband antenna element of claim 1 in which the grounding strips of the first and second fins are connected to the outer taper of the first and second fins and are vertical from the outer taper to the ground plane.

7. The modular wideband antenna element of claim 1 in which the grounding strips of the first and second fins are connected to the outer taper of the first and second fins and are angled from the outer taper to the ground plane.

8. The modular wideband antenna element of claim 1 in which the grounding strips of the first and second fins are connected to the outer taper of the first and second fins and meander from the outer taper to the ground plane.

9. The modular wideband antenna of claim 1 in which the-grounding strips of the first and second fins are connected to the outer taper of the first and second fins and are of equal width from the outer taper to the ground plane.

10. An antenna array comprising a plurality of antenna elements of claim 1.

11. The antenna array of claim 10 comprising a single polarized array in which the first and second fins of the antenna are located in a plurality of parallel planes.

12. The antenna array of claim 10 comprising a dual polarized array in which the first and second fins of one group of antenna elements are located in a plurality of first parallel planes and the first and second fins of another group of antenna elements are located in a plurality of second paralegal planes that are orthogonal to first parallel planes.

13. The modular wideband antenna element of claim 1 comprising at least two grounding stripes connected to the first fin and at least two grounding strips connected to each fin.

14. The modular wideband antenna element of claim 1 in which each of the grounding strips of the first and second fins further comprises a lumped impedance, wherein the lumped impedance comprises a combination of series or parallel connections of resistors, capacitors, and/or inductors.

15. The modular wideband antenna element of claim 1 in which the first fin, the feed stem of the first fin and the one or more grounding strips of the first fin are on a first face of a dielectric layer and the second fin, the ground stem of the second fin and the one or more grounding strips of the second fin are on a second face of the dielectric layer, the first and second faces being parallel.

16. The modular wideband antenna element of claim 1 in which the first and second fins, the feed stem of the first fin, the ground stem of the second fin, and the grounding strips of the first and second fins are made from solid metal.

17. A modular wideband antenna array for connection to a feed network, comprising:

a plurality of antenna elements, each antenna element comprising:

a ground plane;

a first flared fin above the ground plane having an outer flare that tapers exponentially from the to of the fin to the bottom of the fin and an inner flare that tapers exponentially from the to of the fin to the bottom of the fin;

a second flared fin above the ground plane having an outer flare that tapers exponentially from the to of the fin to the bottom of the fin and an inner flare that tapers exponentially from the to of the fin to the bottom of the fin, wherein the inner flares of the first and second flared fins form a radiating tapered slot;

a base of the first fin is electrically connected to an unbalanced line of the feed network by a feed stem of the first fin that extends through the ground plane;

a base of the second fin is electrically connected to the ground plane by a ground stem of the second fin, wherein the feed stem and the ground stem form an unbalanced transverse electric and magnetic mode two conductor transmission line;

the base of the first fin is electrically connected to the ground plane by one or more grounding strips of the first fin; and the base of the second fin is electrically connected to the ground plane by one or more grounding strips of the second fin;

wherein the first and second fins, the feed stem of the first fin, the ground stem of the second fin, and the one or more grounding strips of the first and second fins comprise a single metallization later; and wherein the antenna elements are arranged as a single polarized array in which the first and second fins of the antenna elements are located in a plurality of parallel planes.

18. A modular wideband antenna array for connection to a feed network, comprising:

a plurality of antenna elements, each antenna element comprising: a ground plane;

a first flared fin above the ground plane having an outer flare that tapers exponentially from the to of the fin to the bottom of the fin and an inner flare that tapers exponentially from the top of the fin to the bottom of the fin;

a second flared fin above the ground plane having an outer flare that tapers exponentially from the to of the fin to the bottom of the fin and an inner flare that tapers exponentially from the to of the fin to the bottom of the fin, wherein the inner flares of the first and second flared fins form a radiating tapered slot;

a base of the first fin is electrically connected to an unbalanced line of the feed network by a feed stem of the first fin that extends through the ground plane;

a base of the second fin is electrically connected to the ground plane by a ground stem of the second fin, wherein the feed stem and the ground stem form an unbalanced transverse electric and magnetic mode two conductor transmission line;

the outer taper of the first fin is electrically connected to the ground plane by one or more grounding strips of the first fin; and the outer taper of the second fin is electrically connected to the ground plane by one or more grounding strips of the second fin;

wherein the first and second fins, the feed stem of the first fin, the ground fin of the second fin, and the one or more grounding strips comprise a single metallization later; and wherein the antenna elements are arranged as a dual-polarized array in which the first and second fins of one group of antenna elements are located in a plurality of first parallel planes and the first and second fins of another group of antenna elements are located in a plurality of second parallel planes that are orthogonal to first parallel planes.

19. A modular wideband antenna element for connection to a feed network, comprising:

a ground plane;

a first flared fin above the ground plane having an outer flare that tapers exponentially from the top of the fin to the bottom of the fin and an inner flare that tapers exponentially from the top of the fin to the bottom of the fin;

a second flared fin above the ground plane having an outer flare that tapers exponentially from the top of the fin to the bottom of the fin and an inner flare that tapers exponentially from the top of the fin to the bottom of the fin, wherein the inner flares of the first and second flared fins form a radiating tapered slot;

a base of the first fin is electrically connected to an unbalanced line of the feed network by a feed stem of the first fin that extends through the ground plane;

a base of the second fin is electrically connected to the ground plane by a ground stem of the second fin, wherein the feed stem and the ground stem form an unbalanced transverse electric and magnetic mode two conductor transmission line;

the outer taper of the first fin is electrically connected to the ground plane by one or more grounding strips of the first fin, wherein the one or more grounding strips comprise a lumped impedance; and the outer taper of the second fin is electrically connected to the ground plane by one or more grounding strips of the second fin.

* * * * *